US005583313A

United States Patent [19]

Austin

[11] Patent Number: 5,583,313

[45] Date of Patent: Dec. 10, 1996

[54] RETRACTABLE BLAST PRESSURE AND FLASH SUPPRESSOR ASSEMBLY FOR GUNS

[75] Inventor: Paul A. Austin, Shelburne, Vt.

[73] Assignee: Martin Marietta Corporation, Bethesda, Md.

[21] Appl. No.: 464,228

[22] Filed: Jun. 5, 1995

[51] Int. Cl.[6] ..... F41A 21/34

[52] U.S. Cl. ..... 89/14.2

[58] Field of Search ..... 89/14.3, 14.4, 89/14.2

[56] References Cited

U.S. PATENT DOCUMENTS 4,510,843 4/1985 Rabatin ..... 89/14.4

4,716,809 1/1988 A'Costa ..... 89/14.3

5,433,133 7/1995 La France ..... 89/14.2

*Primary Examiner*—J. Woodrow Eldred

*Attorney, Agent, or Firm*—Robert A. Cahill; Geoffrey H. Krauss

[57] ABSTRACT

A suppressor assembly includes a suppressor that is mounted by rails slidingly received by the barrel clamp of a multi-barreled rotary machine gun to accommodate movement of the suppressor between a latched, operative position projecting beyond the barrel muzzles, effective to suppress blast pressure and flash incident to gun firing, and a latched, stowed position restoring the gun to its normal barrel length.

19 Claims, 3 Drawing Sheets

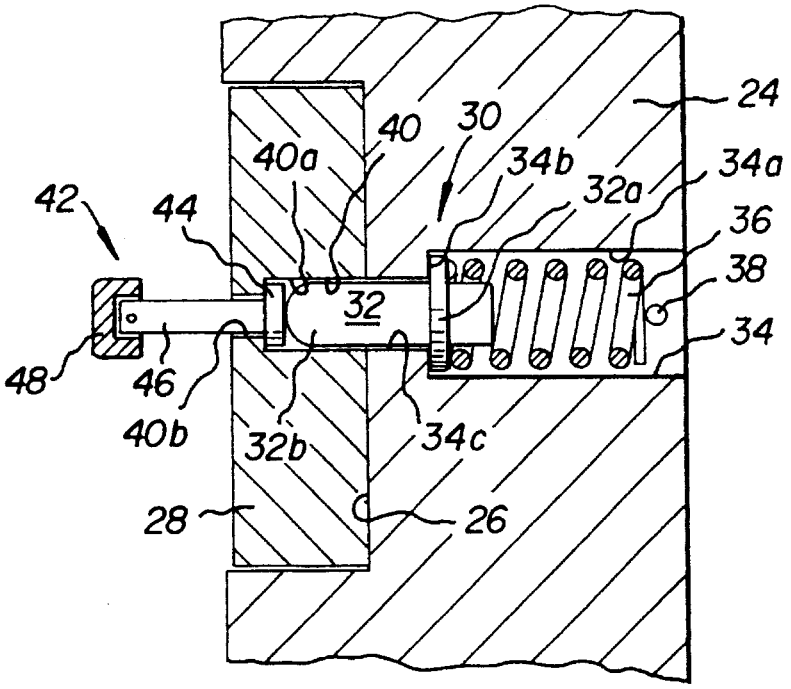
Fig. 3
Fig. 4
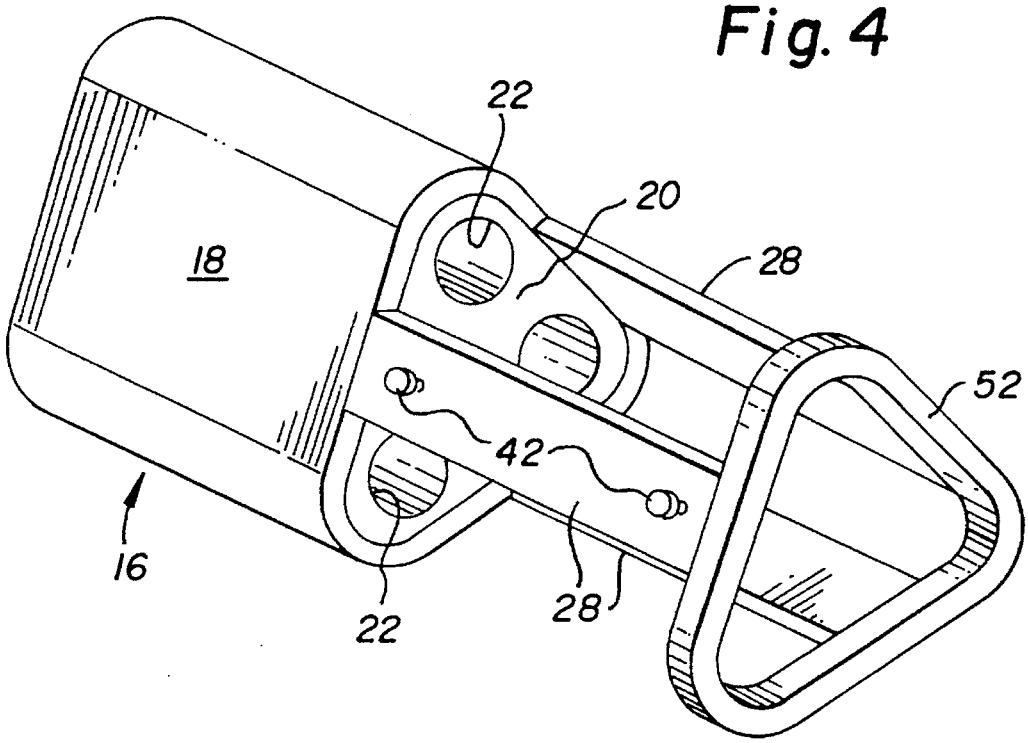

RETRACTABLE BLAST PRESSURE AND FLASH SUPPRESSOR ASSEMBLY FOR GUNS

FIELD OF THE INVENTION

The present invention relates to armaments and particularly to blast pressure and flash suppressors for guns.

BACKGROUND OF THE INVENTION

Suppressors are well-known in the armaments field for reducing blast pressure and flash incident to the firing of a gun. Such suppressors, when assembled to the muzzle of a gun, are effective to muffle the sound and blast pressure wave produced by the projectile as it travels through the gun bore and exits the muzzle of the gun barrel. The blast pressure wave of a 50 calibre rotary machine (Gatling) gun, for example, is particularly forceful and has been known to crack windows of aircraft from which it is being fired. Flash suppression is also an extremely important consideration to minimize detection of the gun position by the enemy, particularly during night fighting. In addition, gun flash readily saturates night vision equipment, thus severely degrading the utility of this equipment for gun operators under low light battle conditions.

Unfortunately, the assembly of a suppressor to the muzzle of a gun barrel, which heretofore has been essentially a fixed assembly, adds at least five inches of barrel length in the case of a 50 calibre rotary machine gun. This extra barrel length presents problems due to the traditionally close confines of military vehicles in which the gun is installed. For example, rotary machine guns are installed in combat helicopters to fire from side opening doors. Normally, the guns are stowed inside the helicopters, but in battle, they are moved into firing positions protruding through the open helicopter doors. In many helicopter installations, the extra barrel length caused by the suppressor assembly interferes with the door frame of the helicopter during designed gun movements between firing and stowed positions. Consequently, the utilization of blast pressure and flash suppressors on rotary machine guns installed as side-firing armaments in combat helicopters is precluded in the case of many existing combat helicopter designs.

SUMMARY OF THE INVENTION

It is accordingly an objective of the present invention to provide an improved suppressor assembly for minimizing gun blast pressure and flash that effectively overcomes the disadvantages and drawbacks of the prior art.

To achieve this objective, in accordance with the present invention, a suppressor assembly is provided as comprising a blast pressure and flash suppressor having an opening through which the barrel of a gun is received and a clamp fixed to the gun barrel at a position spaced from the muzzle of the gun barrel. At least one rail, extending parallel to the gun barrel, is fixed to one of the suppressor and clamp and slidingly received by the other of the suppressor and clamp. By virtue of this construction, the rail guides the suppressor during extension and retraction motions parallel to the gun barrel between an operative position projecting beyond the muzzle of the gun barrel and a stowed position clearing the muzzle of the gun barrel. With the suppressor in its stowed position, the original length of the gun barrel is restored.

In accordance with a preferred embodiment of the invention, the rail is fixed to the suppressor and slidingly received by the barrel clamp. Preferably, a latch is included in the suppressor assembly to releasably detain the suppressor in either of its operative and stowed positions. Also, in a typical application of the present invention, the gun would include a cluster of parallel barrels, such as in the case of rotary machine guns, and the suppressor would include a separate opening for receiving each of the gun barrels. Preferably a plurality of angularly spaced rails are utilized to guide the extension and retraction motions of the suppressor.

Additional features and advantages of the invention will be set forth in the description which follows, and in part will be apparent from the description or may be learned by practicing the invention. The objectives and other advantages of the invention will be attained by the apparatus particularly pointed out in the written description and claims herein, as well as the appended drawings.

It will be understood that both the foregoing general description and the following detailed description are exemplary and explanatory and are intended to provide further explanation of the invention as claimed.

The accompanying drawings are included to provide further understanding of the invention and are incorporated in and constitute a part of the specification, illustrate several embodiments of the invention and together with the description serve to explain the principals of the invention.

BRIEF DESCRIPTION OF THE DRAWINGS

FIG. 3 is a fragmentary sectional view of a latch utilized in the suppressor assembly of FIGS. 1 and 2 for releasably detaining the suppressor in either of its operative and stowed positions; and FIG. 4 is a perspective view of the retractable portion of a suppressor assembly structured in accordance with an alternative embodiment of the invention.

Like reference numerals refer to corresponding parts throughout the several views of the drawings.

DETAILED DESCRIPTION OF THE PREFERRED EMBODIMENTS

Figure 1:
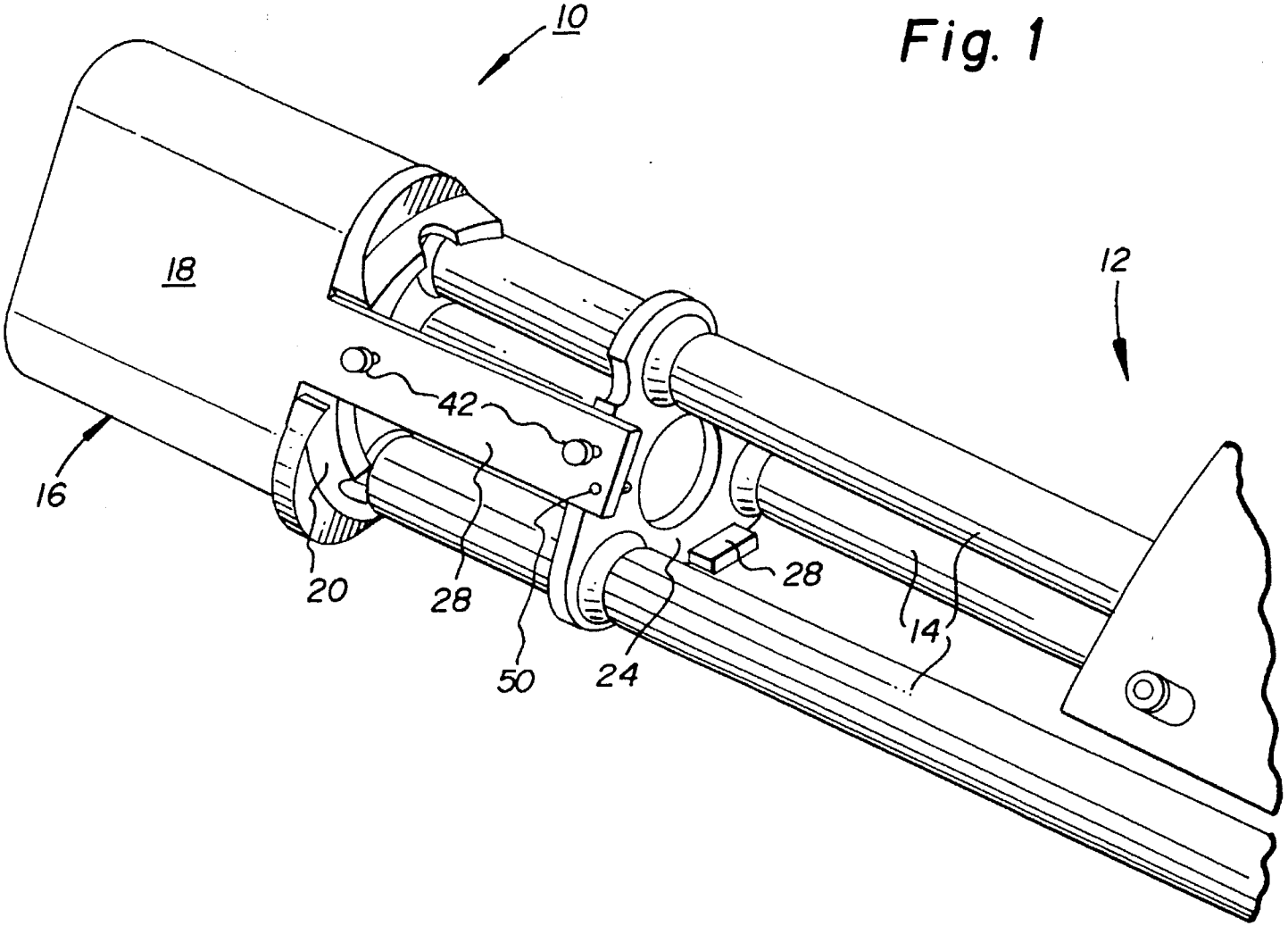
FIG. 1 is a perspective view of a rotary machine gun utilizing a blast pressure and flash suppressor assembly structured in accordance with a preferred embodiment of the invention, with the suppressor illustrated in its extended, operative position.
Figure 2:
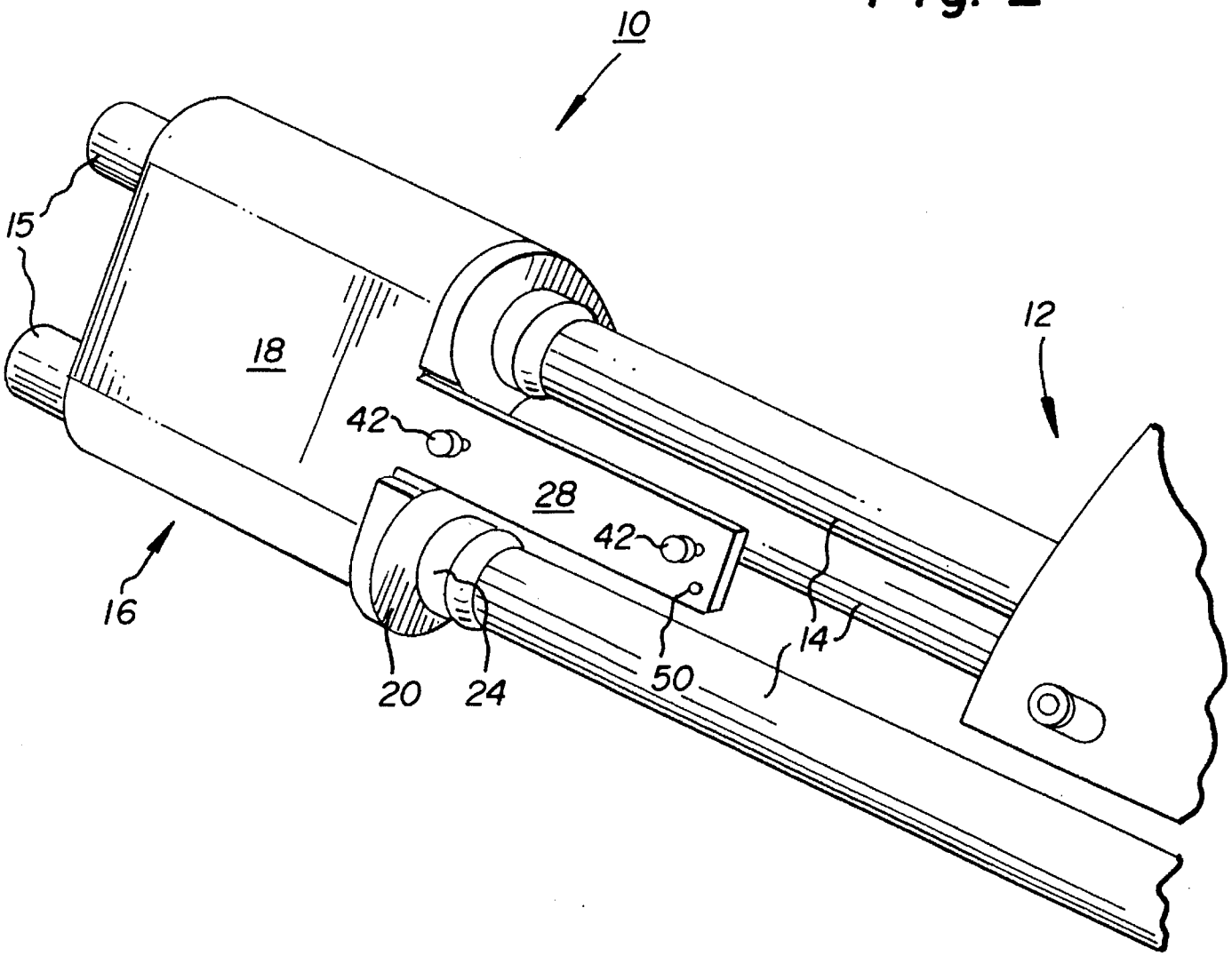
FIG. 2 is a perspective view of the gun and suppressor assembly of FIG. 1, with the suppressor illustrated in its retracted, stowed position.

Referring jointly to FIGS. 1 and 2, the gun blast pressure and flash suppressor assembly of the present invention, as generally indicated at 10, is illustrated in its application to a rotary machine gun, often referred to as a Gatling gun, fragmentarily indicated at 12. While this rotary machine gun is shown having a cluster of three barrels 14, it will be appreciated that such rotary machine guns are often equipped with a greater number of barrels closely clustered in parallel relation. For that matter, a suppressor assembly according to the present invention may be advantageously adapted to a single-barreled or a double-barreled gun.

In accordance with the invention, the suppressor assembly includes a suppressor having an opening for receiving the gun barrel. As embodied herein, the suppressor assembly 10 includes a suppressor, generally indicated at 16, that may be basically structured in a conventional manner known to be effective in minimizing blast pressure and flash when installed in a normal, fixed manner to the muzzle of a gun barrel or barrels. Thus, suppressor 16 includes an outer casing 18 of an appropriate shape (triangular in the case of a three-barreled rotary machine gun). At least the breach end of casing 18 is closed off by a plate 20 provided with a separate opening 22, best seen in FIG. 4, for receiving each of the three gun barrels 14.

Further in accordance with the invention, the suppressor assembly includes a clamp fixable to the gun barrel at a position spaced from the muzzle. As embodied herein, fixed to the three gun barrels in a position appropriately spaced from the muzzles 15 (FIG. 2) of the gun barrels is a triangular-shaped clamp 24 of the type normally utilized in rotary machine guns to secure the barrel cluster at a location adjacent to muzzles, but modified in accordance with the present invention as discussed below.

Still further in accordance with the present invention, the suppressor assembly includes at least one rail extending parallel to the gun barrel and fixed to one or the other with the suppressor and clamp and slidingly received by the other of the suppressor and clamp. As embodied herein, clamp 24 is machined at each of its three sides to provide grooves 26, best seen in FIG. 3, for slidingly receiving three elongated, equiangularly spaced rails 28 of rectangular cross-section. The rails 28 are fixed at their outer (muzzle) ends to suppressor 16 and extend toward the breech end of the gun in parallel relation with the gun barrels and through the barrel clamp grooves 26 to free end terminations located beyond the barrel clamp.

From the foregoing description, it is seen that suppressor 16 is mounted to gun 12 for movement in extension, parallel to gun barrels 14, to an operative position, seen in FIG. 1, projecting beyond the muzzles 15 of the gun barrels 14 and for moving in retraction to a stowed position, seen in FIG. 2, clearing the barrel muzzles 15. In its operative position suppressor 16 is disposed to suppress blast pressure and flash during gun firing. With the suppressor in the stowed position, the gun 12 is restored to its normal barrel length for unimpeded movement between a firing position and a stowage position consistent with the design constraints of the combat platform on which gun 12 is installed.

As an additional feature of the present invention, suppressor assembly 10 is equipped with a latch to releasably detain suppressor 16 in either its stowed position or its operative position. Referring to FIG. 3, this latch, generally indicated at 30, includes a plunger 32 operating in a countersunk radial bore 34 drilled through one of the three sides of barrel clamp 24 into the groove 26 machined therein. A coil spring 36, confined in the large diameter section **34*a* of bore 34 by a pin 38, acts on an angular flange 32*a* of plunger 32 to seat this flange against the annular shoulder 34*b* between the large diameter bore section and the reduced diameter bore section 34*c* to which a latch tip section 32*b* of plunger 32** protrudes.

The one rail 28, slidingly received in the barrel clamp groove 26 in which latch 30 is incorporated, is drilled to provide a pair of longitudinally spaced countersunk bores 40, one seen in FIG. 3. Each bore 40 is equipped with a latch release button, generally indicated at 42 and FIGS. 1–3. Each button 42 includes and enlarged foot 44 accommodated in the large diameter section **40*a* of bore 40 into which the latch tip 32*b* of plunger 32 can protrude and a stem 46 extending out through the reduced diameter section of 40*b* of bore 40. An enlarged head 48 is pinned to the outer end of stem 46 to capture each latch release button 42 in its associated rail bore 40**.

When suppressor 16 assumes its operative position seen in FIG. 1, the bore 40 adjacent the free end of the one rail 28 registers with the bore 34 in barrel clamp 24, and the plunger latch tip **32*b* springs outwardly into the rail bore to latch the suppressor in its operative position. The latch release button 42 installed adjacent the free end of the rail is depressed to forcibly retract plunger 32, unlatching the suppressor 16** from its operative position.

One of the rails 28 is preferably equipped with a stop pin 50 that abuts the breech-side face of the barrel clamp 24 to prevent inadvertent removal of the suppressor-rails movable unit from gun 12. In practice, it may be desirable to implement stop pin 50 as a bolt that may be turned partially out of a tapped hole in the rail 28 to permit complete removal of this movable unit for certain gun firing situations.

Stop pin 50 may also serve the purpose of a locating pin that engages the barrel clamp when the suppressor 16 assumes the desired operative position coincident with the rail bore achieving registry with the barrel clamp bore. The plunger latch tip **32*b* can then spring outwardly into the rail bore 40** to latch the suppressor in its operative position.

The position of the other rail bore 40 approximate suppressor 16 is set such that when the suppressor face plate 20 abuts the barrel clamp 24 to define a suppressor stowed position, this rail bore registers with the barrel clamp bore 34. The plunger latch tip **32*b* can then readily spring into this rail bore, latching the suppressor in its stowed position. The latch release button 42 then can be depressed to retract the plunger latch tip from this rail bore, thereby defeating latch 30, such that the suppressor 16** can be extended to its operative position.

The embodiment of the invention seen in FIG. 4 differs from the embodiment of FIGS. 1 and 2 only in the addition of a triangularly shaped tie member 52 affixed to the free ends of rails 28 extending beyond the breech side of barrel clamp 24. The addition of tie member 52 stabilizes the relative positions of the rails 28 and assures smoothly guided reciprocation of the suppressor 16 between its operative and stowed positions.

While it is preferred that the pressure assembly rails 28 be fixed to suppressor 16 and slidingly received by barrel clamp 24, as described above and illustrated in the drawings, it will be appreciated that the objectives of the present invention may be achieved by fixing the rails to the bell clamp and structuring the suppressor to slidingly receive the rails. It will also be readily understood that gun 12 is fully operational while suppressor 16 is in its stowed position.

It will be apparent to those skilled in the art that various modifications and variations can be made in the apparatus of the present invention without departing from the spirit and scope of the present invention. Thus, it is intended that the present invention cover the modifications and variations of this invention provided they come within the scope of the appended claims and their equivalents.

What is claimed is:

1. A suppressor assembly for adaption to a gun for reducing blast pressure and flash during firing of the gun, the assembly comprising:

a suppressor including an opening for receiving the gun barrel;

a clamp fixable to the gun barrel at a position spaced from the muzzle of the gun barrel;

at least one rail extending parallel to the gun barrel between the suppressor and the clamp, the rail fixed to one of the suppressor and clamp and slidingly received by the other of the suppressor and clamp, whereby to accommodate extension and retraction motions of the suppressor parallel with the gun barrel between an operative position projecting beyond the muzzle of the gun barrel and stowed position clearing the muzzle of the gun barrel.

2. The suppressor assembly defined in claim 1, further comprising a latch operatively interengaging the rail and the clamp for releasably detaining the suppressor in the operative position.

3. The suppressor assembly defined in claim 1, further comprising a latch operatively interengaging the rail and the clamp for releasably detaining the suppressor in each of the operative and stowed positions.

4. The suppressor assembly defined in claim 1, wherein the rail is fixed to the suppressor and slidingly received by the clamp.

5. The suppressor assembly defined in claim 4, wherein the suppressor includes a plurality of openings for respectively receiving a corresponding plurality of parallel, coextensive gun barrels of a gun barrel cluster, and wherein at least three rails extend parallel to the plural gun barrels between the suppressor and the clamp.

6. The suppressor assembly defined in claim 5, wherein the clamp includes at least three angularly spaced grooves for respectively slidingly receiving the at least three rails.

7. The suppressor assembly defined in claim 6, further including a tie member fixed to free ends of the at least three rails extending beyond the clamp.

8. The suppressor assembly defined in claim 6, further including a latch operatively interengaging the rail and the clamp for releasably detaining the suppressor in the operative position.

9. The suppressor assembly defined in claim 8, wherein the latch includes a first bore proved in one of the rails, a second bore provided in the clamp, and a latch member movably mounted in one of the first and second bores, the first bore being registered with the second bore when the suppressor is extended to the operative position, such that the latch member can be latchingly received in the other of the first and second bores to detain the suppressor in the operative position.

10. The suppressor assembly defined in claim 9, further including a removable stop element carried by any one of the rails at a position to engage the clamp and prevent removal of the suppressor from the gun.

11. The suppressor assembly defined in claim 9, wherein the latch member is mounted in the second bore together with a latch spring for forcing the latch member into the first bore, the latch further including a release button movably mounted in the first bore for retracting the latch member from the first bore against the force of the latch spring to unlatch the suppressor from the operating position.

12. The suppressor assembly defined in claim 11, wherein the latch further includes a third bore provided in the one rail in spaced relation to the first bore, the third bore registering with the second bore when the suppressor is retracted to the stowed position, and the latch spring forcing the latch member into the third bore to detain the suppressor in the stowed position, the third bore movably mounting an additional release button for retracting the latch member from the third bore against the force of the latch spring to unlatch the suppressor from the stowed position.

13. A gun comprising:

at least one barrel having a muzzle; and a suppressor assembly including:

a suppressor including an opening for receiving the gun barrel;

a clamp fixable to the gun barrel at a position spaced from the muzzle of the gun barrel;

at least one rail extending parallel to the gun barrel between the suppressor and the clamp, the rail fixed to one of the suppressor and clamp and slidingly received by the other of the suppressor and clamp, whereby to accommodate extension and retraction motions of the suppressor parallel with the gun barrel between an operative position projecting beyond the muzzle of the gun barrel to induce blast pressure and flash in incident to firing of the gun and stowed position clearing the muzzle of the gun barrel.

14. The gun defined in claim 13, wherein the rail is fixed to the suppressor and slidingly received by the clamp.

15. The gun defined in claim 14, further comprising a plurality of parallel, coextensive barrels, and wherein the suppressor includes a plurality of openings for respectively receiving the plurality of gun barrels of a gun barrel cluster, and wherein the suppressor assembly includes at least three angularly spaced rails fixed to the suppressor and slidingly received by the clamp.

16. The gun defined in claim 15, wherein the clamp includes at least three angularly spaced grooves for respectively slidingly receiving the at least three rails.

17. The gun defined in claim 16, further including a tie member fixed to free ends of the at least three rails extending beyond the clamp.

18. The gun defined in claim 16, further comprising a latch operatively interengaging the rail and the clamp for releasably detaining the suppressor in the operative position.

19. The gun defined in claim 16, further comprising a latch for releasably detaining the suppressor in each of the operative and stowed positions.

* * * * *